United States Patent [19]

Gerdes

[11] Patent Number: 4,805,370

[45] Date of Patent: Feb. 21, 1989

[54] CABINET CORNER CAP AND METHOD OF ASSEMBLY

[75] Inventor: Keith W. Gerdes, Louisville, Ky.

[73] Assignee: General Electric Company, Louisville, Ky.

[21] Appl. No.: 76,476

[22] Filed: Jul. 20, 1987

[51] Int. Cl.[4] ..... F16B 12/00; B65B 7/00

[52] U.S. Cl. ..... 52/716; 52/288; 52/468; 24/297; 220/80; 220/433

[58] Field of Search ..... 52/464, 468, 716; 49/492, 479; 411/510, 509, 508; 24/292, 293, 294, 297, 453, 289; 312/140, 236; 220/80, 73, 433, 434

[56] References Cited

U.S. PATENT DOCUMENTS

| | | | |
|---|---|---|---|
| 1,774,121 | 8/1930 | Wilson . | |
| 2,205,780 | 6/1940 | Forsthoefel | 220/9 |
| 2,267,294 | 12/1941 | Yoxsimer | 220/9 |
| 2,286,109 | 6/1942 | Rundell | 220/9 |
| 2,348,645 | 5/1944 | Quinn | 220/9 |
| 2,348,812 | 5/1944 | Heath | 220/9 |
| 2,777,598 | 1/1957 | Gaul | 220/15 |
| 3,889,320 | 6/1975 | Koscik | 24/297 |
| 4,196,952 | 4/1980 | Crowe | 312/236 |
| 4,402,118 | 9/1983 | Benedetti | 24/289 |
| 4,402,641 | 9/1983 | Arff | 411/510 |
| 4,488,206 | 12/1984 | Mizusawa | 24/297 |
| 4,489,465 | 12/1984 | Lemkin | 24/297 |
| 4,564,163 | 1/1986 | Barnett | 24/297 |
| 4,739,543 | 4/1988 | Harris | 24/297 |

FOREIGN PATENT DOCUMENTS 1106122 8/1956 Fed. Rep. of Germany ..... 49/492

*Primary Examiner*—John E. Murtagh

*Attorney, Agent, or Firm*—Frederick P. Weidner; Radford M. Reams

[57] ABSTRACT

A cabinet corner cap and method of assembly comprising forming metal sheet into a cabinet corner having an elongated space at the junction of two panels of the metal sheet forming the corner. A corner cap is molded from suitable plastic material and has an elongated horizontal top wall with a central longitudinal axis and a vertical wall projecting downwardly from the central longitudinal axis of the top wall and extending a major portion of the length of the horizontal top wall. The vertical wall includes a series of spaced apart ribs perpendicular to and on each side of the vertical wall and diverging away from the vertical wall in the direction of the top wall and joining the horizontal top wall. The vertical wall also has resilient fingers secured at one end to the vertical wall and free ends extending toward and spaced from the horizontal top wall a distance at least the thickness of the metal sheet forming the cabinet corner and the fingers diverge outwardly from the vertical wall a distance greater than the ribs and the width of the elongated space. The vertical wall of the corner cap is inserted into the elongated space at the junction of the two panels and the ribs center the corner cap in the space. Force is applied to the corner cap to pass the resilient fingers through the space to allow the fingers to spring back and span the width of the elongated space, thus retaining the corner cap in position to cover the elongated space in the cabinet corner.

6 Claims, 3 Drawing Sheets

CABINET CORNER CAP AND METHOD OF ASSEMBLY

BACKGROUND OF THE INVENTION

In the construction of a cabinet, such as a household refrigerator cabinet, it is often desirable to provide a corner cap to cover the open miter at the corners of the outer case which is formed of prepainted metal sheet. In such cases, it is also desirable to provide a seal at the corners to prevent the leakage of insulating foam through the open miter during the foam-in process to insulate the refrigerator cabinet. It is further desirable that the corner cap be as thin as possible to present minimum interference with the gasket sealing effectiveness such as in the case of a refrigerator where the gasket around the door seals the interior of the refrigerator from the ambient atmosphere. In addition, the corner cap must be firmly retained so that removal is not possible without breaking the cap and, accordingly, the cap should be easily replaceable in the event it breaks during manufacture or during field service of the refrigerator. The corner cap must be able to tolerate case or cabinet dimensional variation as occurs in manufacture of the cabinet.

By my invention, there is provided a corner cap for a cabinet such as a household refrigerator cabinet and a method of assembly that accomplishes all of the above mentioned desirable attributes.

SUMMARY OF THE INVENTION

A cabinet corner cap and method of assembly comprising forming metal sheet into a cabinet corner having an elongated space at the junction of two panels of the metal sheet forming the corner. A corner cap is molded from suitable plastic material and has an elongated horizontal top wall with a central longitudinal axis and a vertical wall projecting downwardly from the central longitudinal axis of the top wall and extending along a major portion of the length of the horizontal top wall. The vertical wall includes a series of spaced apart ribs perpendicular to and on each side of the vertical wall and diverging away from the vertical wall in the direction of the top wall and joining the horizontal top wall. The vertical wall also has resilient fingers secured at one end to the vertical wall and free ends extending toward and spaced from the horizontal top wall a distance at least the thickness of the metal sheet forming the cabinet corner and the fingers diverge outwardly from the vertical wall a distance greater than the ribs and the width of the elongated space. The vertical wall of the corner cap is inserted into the elongated space at the junction of the two panels and the ribs center the corner cap in the space. Force is applied to the corner cap to pass the resilient fingers through the space to allow the fingers to spring back and span the width of the elongated space, thus retaining the corner cap in position to cover the elongated space in the cabinet corner.

DESCRIPTION OF THE PREFERRED EMBODIMENT

Figure 1:
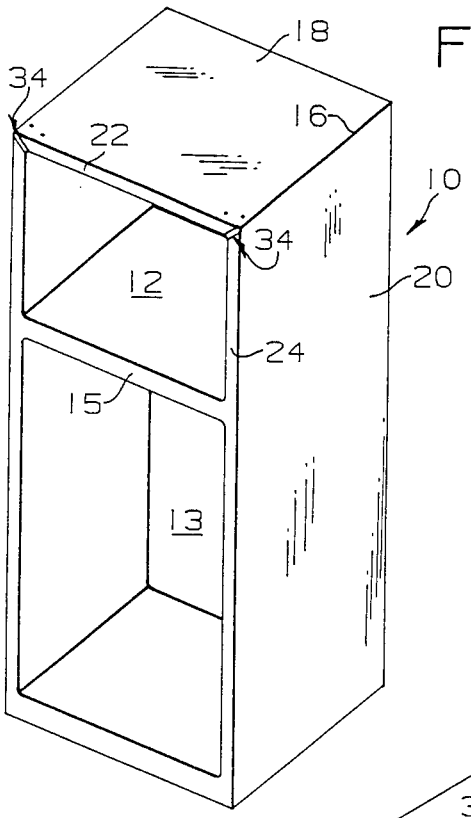
FIG. 1 is a perspective view of a top mount refrigerator cabinet showing both the fresh food compartment below and the freezer compartment above and including the corner cap of the present invention.

Referring to FIG. 1, a refrigerator outer case or cabinet 10 such as a top mount household refrigerator, for example, has a freezing compartment 12, and a fresh food compartment 13 separated by a partition 15. The freezer compartment and the fresh food compartment would have a door or doors (not shown) for closing the respective compartments when the refrigerator is completely assembled. The cabinet 10 is constructed from metal sheet and in many cases from a single sheet of metal with the corners, such as corner 16, being bent to form a radius or curved section such as between top panel 18 and side panel 20, which are disposed at right angles to each other. To provide a surface or face at the front of the refrigerator cabinet 10, the panels of the cabinet have depending flanges such as flanges 22 and 24 for panels 18 and 20, respectively, and these flanges provide surfaces against which the freezer and fresh food compartment door gaskets (not shown) magnetically seal those compartments. While the invention will be described in connection with only one top corner 16, it will be understood that the corner cap of the present invention may be used on the other top corner of the cabinet 10 as they are both identical.

Figure 2:
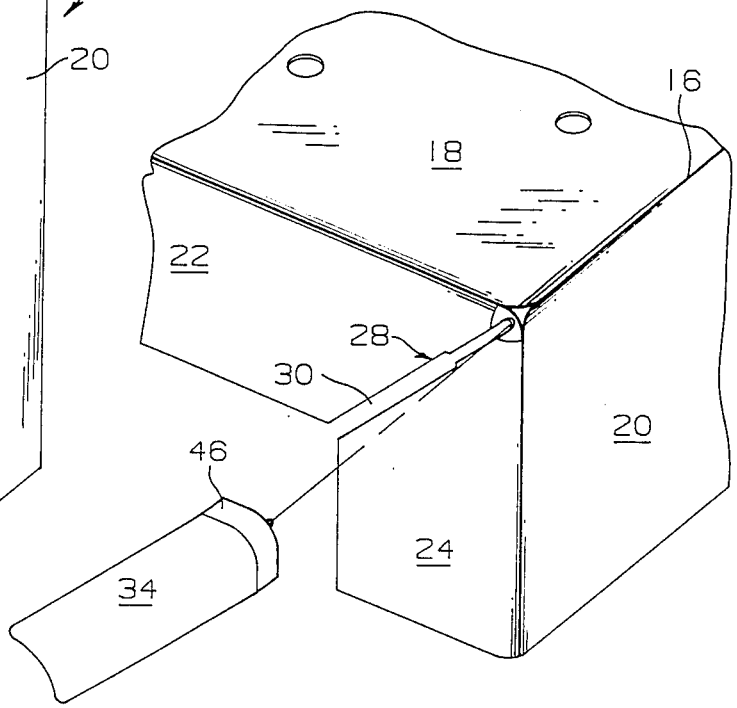
FIG. 2 is a fragmental perspective view of a corner of the refrigerator cabinet shown in FIG. 1 and including the corner cap of the present invention.
Figure 3:
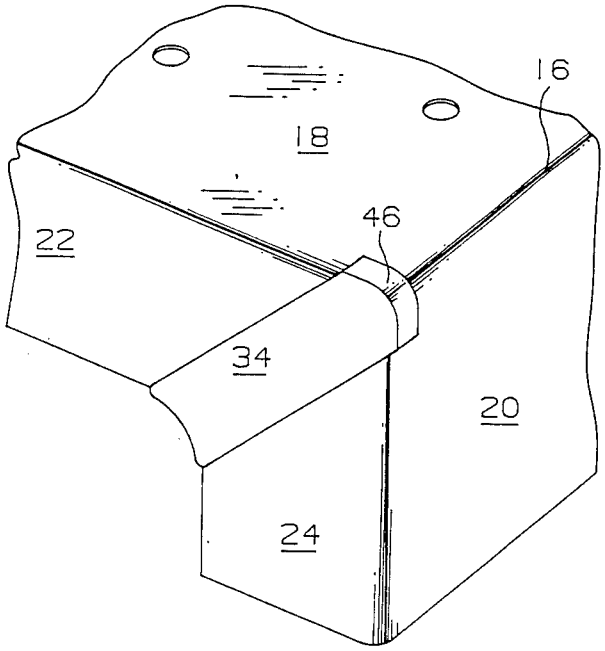
FIG. 3 is similar to FIG. 2 wherein the corner cap of the present invention is secured to the corner of the refrigerator cabinet.

As best seen in FIGS. 2 and 3, to accomplish bending of the panels 18 and 20 and their respective flanges 22 and 24 during the forming of the cabinet 10, there usually is a miter joint 28 to allow the panels and flanges to be formed at right angles to each other without interference of the overlapping material. The miter joint includes a slit or an elongated space 30 from the end of the flange away from the panels 18 and 20 back to the curved corner 16 and it is this elongated space 30 that needs to be covered by a corner cap 34.

Figure 4:
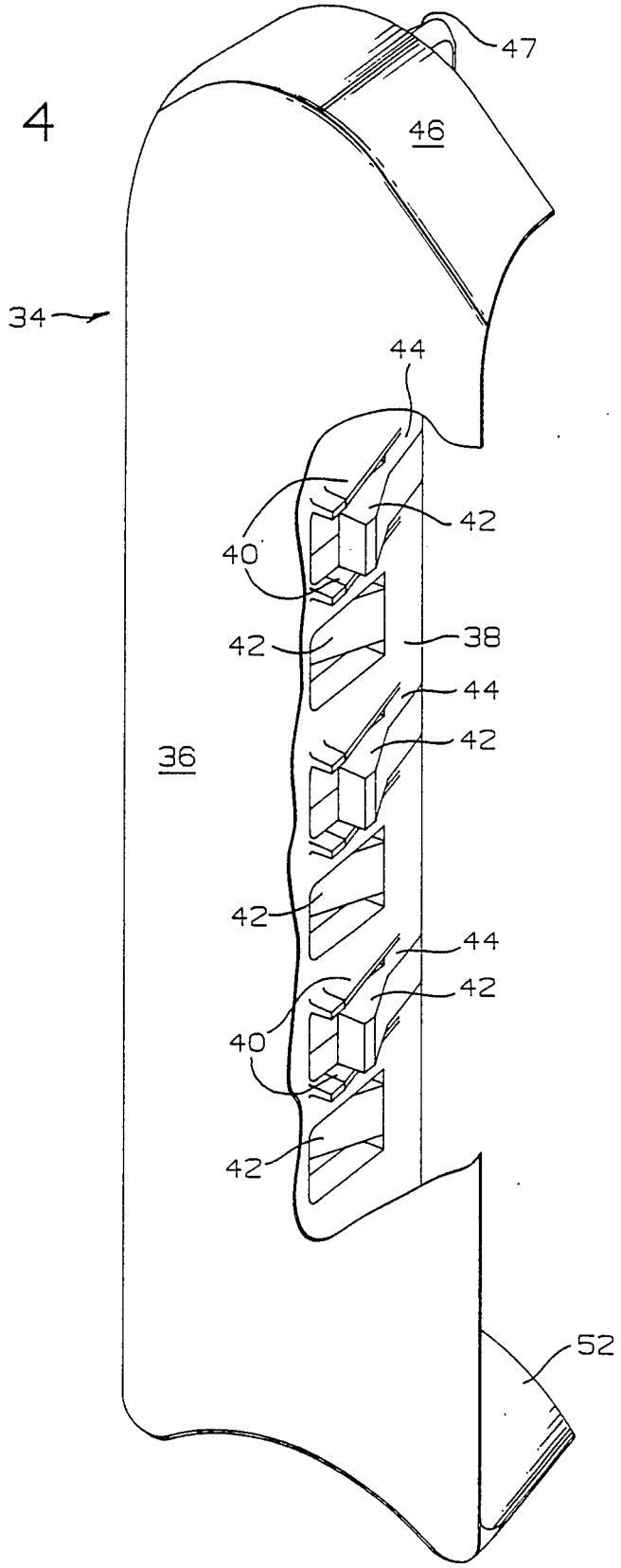
FIG. 4 is an enlarged perspective view of the corner cap of the present invention with portions broken away to show details of structure.
Figure 5:
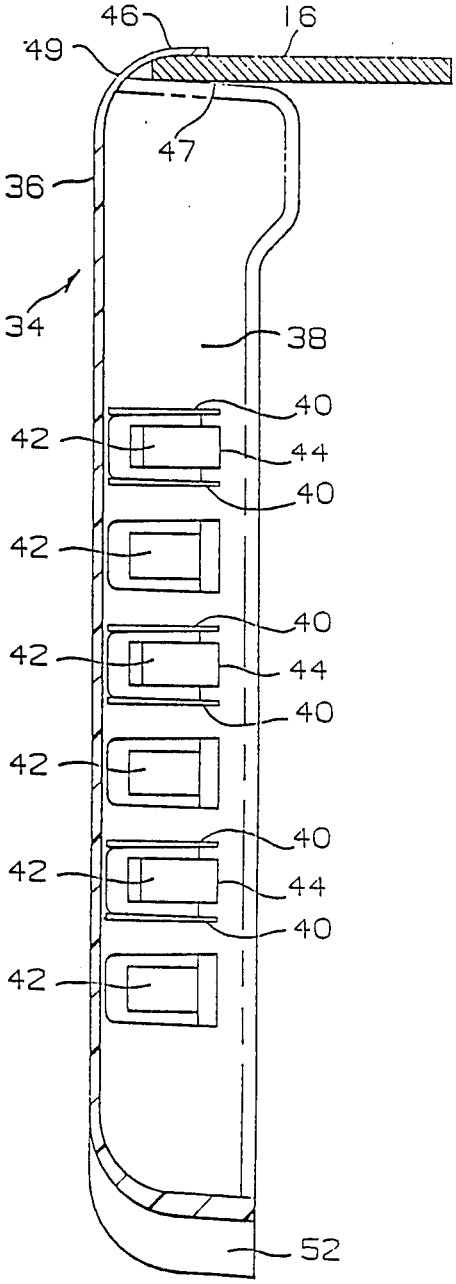
FIG. 5 is a cross-sectional view of the corner cap of the present invention.
Figure 7:
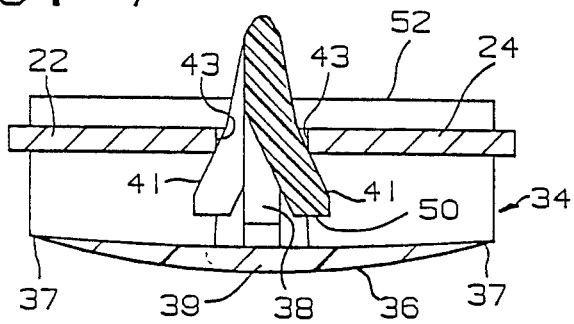
FIG. 7 is similar to FIG. 6 showing the second stage of assembling the corner cap of the present invention in the cabinet.
Figure 8:
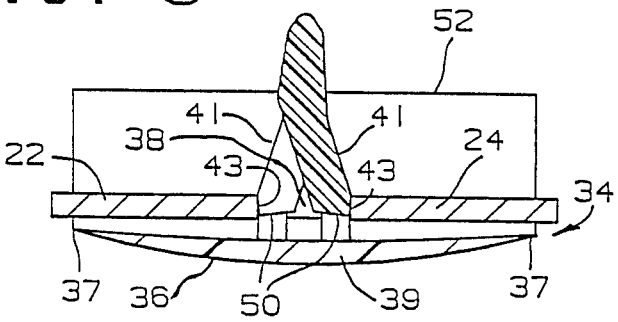
FIG. 8 is similar to FIGS. 6 and 7 and shows the third stage of assembling the corner cap in the cabinet.

With reference particularly to FIGS. 4 and 5, the details of the corner cap 34 of the present invention will now be discussed. The corner cap 34 is preferably molded from suitable plastic material and includes an elongated horizontal top wall 36 with a central longitudinal axis. The top wall 36, as best seen in FIGS. 6–9, is plano-convex with edges 37 being very thin relative to the central area 39 located along the central longitudinal axis. The corner cap also has a vertical wall 38 projecting downwardly from the central longitudinal axis of the top wall 36 and extending a major portion of the length of the top wall 36. The vertical wall 38 has a series of spaced apart ribs 40 perpendicular to and on each side of the vertical wall 38. The ribs 40 diverge away from the vertical wall 38 in the direction of the top wall 36 such that the edges 41 of the ribs are in the form of an inclined plane and these ribs join the horizontal top wall. Due to variations in manufacturing tolerances the width of the elongated space 30 may vary from the nominal dimension. The minimum and maximum space width can usually be determined and the rib dimensions at the junction of the top wall 36 should be such that the ribs on both sides of the vertical wall will span or very nearly span the maximum space width, thereby tending to center the corner cap in the elongated space 30. The vertical wall 38 further includes resilient fingers 42 secured at one end 44 to the vertical wall 38 and free ends 50 extending toward and spaced from the horizontal top wall a distance at least the thickness of the metal sheet forming the cabinet corner and the fingers diverge outwardly from the vertical wall 38 a distance greater than the ribs 40. Therefore, the span of the fingers 42 on both sides of the vertical wall will be greater than the maximum space 30 width.

With reference to FIGS. 4 and 5, again in particular, it will be noted that the ribs 40 are in pairs with the resilient fingers 42 between the ribs of each pair. Further, the series of spaced apart ribs 40 alternate on each side of the vertical wall 38 along the length thereof. It will be further noted in FIG. 2 that the junction of the two panels 18 and 20 forms a curved corner 16 and the corner cap as shown has one end 46 correspondingly curved to the curve of the junction of the cabinet panels.

Figure 6:
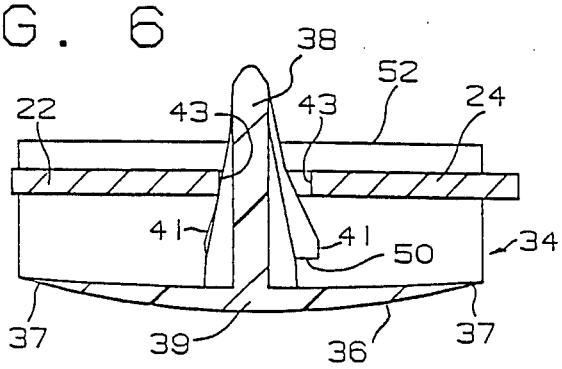
FIG. 6 shows the first step in assembling the corner cap of the present invention in the cabinet.
Figure 9:
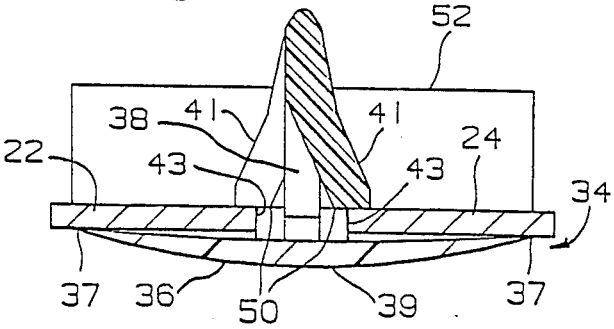
FIG. 9 is similar to FIGS. 6, 7 and 8 and shows the final stage of assembling the corner cap in the cabinet.

With the corner cap structural arrangement as described above, it is utilized to fit into and cover the elongated space 30 at the corner of the cabinet and the corner caps when secured to the cabinet are utilized to prevent the leakage of insulating foam through the open miter or elongated space 30 during the foaming process to thermally insulate the cabinet. In this connection it is important that the corner cap firmly grip the corner of the case so that force exerted on the corner cap by the foaming operation will not blow out the corner cap and allow the expanding foam to escape through the elongated space 30. After the cabinet has been assembled as described above in connection with forming corners having elongated spaces 30 at the junction of the two panels of the metal sheet forming the corner, the one end 47 of vertical wall 38 of the corner cap is inserted into the elongated space 30. As shown in FIG. 5, the one end 46 of the corner cap 34 is spaced from the end 47 of the vertical wall 38 a distance equal to the maximum tolerance thickness of the metal sheet forming the corner 16. An area 49 near the top wall 36 between the one end 46 and the corner 16 has a taper to accommodate minimum to maximum thickness of the metal sheet forming the corner 16. For appearance purposes the end 46 and the corner 16 should fit as tight to each other as possible. As shown in FIG. 6, with further insertion of the vertical wall 38 into the elongated space 30 the inclined edges 41 of the ribs 40 contact the edges 43 of space 30 and act to center the corner cap in the space 30 if the corner cap is off center as shown in FIG. 6. Continued insertion of the vertical wall 38 results in a centered position of the corner cap at near nominal dimensions of the elongated space 30, which is the second stage of assembly shown in FIG. 7 and the resilient fingers 42 engage the edges 43 of the elongated space 30. Continued insertion of the vertical wall 38 results in the free ends 50 of the resilient fingers 42 being collapsed or squeezed together to a distance equal to the width of the elongated space 30 and the final insertion force results in having the free ends 50 of the resilient fingers 42 pass through the elongated space 30 and once through the elongated space the free ends of the fingers spring back and span the width of the elongated space as shown in FIG. 9. In the event the width of the elongated space 30 is less than the width of the ribs 40 on both sides of the vertical wall 38 where they join the top wall 36, continued insertion force will merely deform the relatively thin ribs 40 against the edges 43 of the space 30 and not interfere with having the resilient fingers 42 pass through the elongated space 30. In the event the width of the elongated space 30 is at maximum dimension, the ribs position or orient the corner cap relative to the elongated space width so that all the resilient fingers will span the width of the elongated space 30. It will be appreciated that with this arrangement force exerted on the underside of the corner cap 34 as by the insulation foaming operation will be resisted by the free ends 50 of the resilient fingers contacting surface 48 of the metal sheet that forms the elongated space 30 at the junction of the two panels at the cabinet corner and prevent foam from leaking through space 30.

The end of the corner cap 34 opposite from end 46 has a curved portion 52 that depends downwardly from the horizontal top wall 36 and is attached at its center to the vertical wall 38. This curved portion 52 spans the open end of the elongated space 30 and contacts both flanges 22 and 24 and conceals the edges of the elongated space 30 to enhance the appearance of the face of the refrigerator cabinet 10.

The foregoing is a description of the preferred embodiment of the invention and it should be understood that variations may be made thereto without departing from the true spirit of the invention as defined in the appended claims.

What is claimed is:

1. A corner cap for insertion into a space at the junction of two panels of a cabinet comprising:

an elongated horizontal top wall having a central longitudinal axis; and a continuous vertical wall projecting downwardly from the central longitudinal axis of the top wall and extending a major portion of the length of the horizontal top wall, said vertical wall having;

a series of spaced apart deformable ribs perpendicular to and on each side of the vertical wall and diverging away from the vertical wall in the direction of the top wall and joining the horizontal top wall, and resilient fingers secured at one end to the vertical wall and having free ends extending toward and spaced from the horizontal top wall, said fingers diverging outwardly from the vertical wall a distance greater than the ribs and the width of the space at the junction of two panels of the cabinet.

2. The corner cap of claim 1 wherein the ribs are in pairs with the resilient fingers between the ribs of each pair.

3. The corner cap of claim 1 wherein the series of spaced apart ribs alternate on each side of the vertical wall.

4. The corner cap of claim 1 wherein the corner cap is integrally formed.

5. The corner cap of claim 4 wherein the integrally formed corner cap is made from thin plastic material.

6. The corner of claim 1 wherein the junction of the two panels is curved and the corner cap has one end correspondingly curved to the curve of the junction of the cabinet panels.

* * * * *